US008973714B2

(12) United States Patent
Utsunomiya et al.

(10) Patent No.: US 8,973,714 B2
(45) Date of Patent: Mar. 10, 2015

(54) DOOR ENGAGEMENT DEVICE FOR ELEVATOR

(75) Inventors: Kenji Utsunomiya, Tokyo (JP); Hiroshi Kigawa, Tokyo (JP); Masaya Kitazawa, Tokyo (JP); Naotoshi Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 463 days.

(21) Appl. No.: 13/386,747

(22) PCT Filed: Oct. 6, 2010

(86) PCT No.: PCT/JP2010/067552

§ 371 (c)(1),
(2), (4) Date: Jan. 24, 2012

(87) PCT Pub. No.: WO2011/043378

PCT Pub. Date: Apr. 14, 2011

(65) Prior Publication Data

US 2012/0118676 A1 May 17, 2012

(30) Foreign Application Priority Data

Oct. 9, 2009 (JP) ..... 2009-235144

(51) Int. Cl.
*B66B 13/12* (2006.01)

(52) U.S. Cl.
CPC ..... *B66B 13/12* (2013.01)
USPC ..... 187/319; 187/330

(58) Field of Classification Search
CPC ..... B66B 13/12
USPC ..... 187/319, 330; 49/120, 123
See application file for complete search history.

(56) References Cited

U.S. PATENT DOCUMENTS

| | | | | |
|---|---|---|---|---|
| 4,947,964 | A * | 8/1990 | Husmann | 187/319 |
| 5,246,089 | A * | 9/1993 | Husmann et al. | 187/319 |
| 7,370,731 | B2 * | 5/2008 | Cocher | 187/330 |
| 8,607,937 | B2 * | 12/2013 | Gilli | 187/319 |

FOREIGN PATENT DOCUMENTS

| | | |
|---|---|---|
| DE | EP 0 513 509 A1 | 11/1992 |
| JP | 8-143252 A | 6/1996 |
| JP | 2842513 | 10/1998 |
| JP | 2006 103882 | 4/2006 |
| JP | 2008-230844 A | 10/2008 |

OTHER PUBLICATIONS

English Machine Translation of JP 08-143252 A.*

(Continued)

*Primary Examiner* — William E Dondero
*Assistant Examiner* — Diem Tran
(74) *Attorney, Agent, or Firm* — Oblon, McClelland, Maier & Neustadt, L.L.P.

(57) ABSTRACT

A door engagement device for an elevator according to the present invention is configured in such a manner that biasing-force applying/changing means applies a turning preventing force for preventing turning of a lever main body and changes a direction of a biasing force to a direction of an anti-turning preventing force to the lever main body by action of turning guiding means with movement of a car door. Accordingly, an engagement-mechanism driving device can be driven with a reduced space at low cost.

9 Claims, 11 Drawing Sheets

(56) References Cited

OTHER PUBLICATIONS

Office Action issued Jun. 25, 2013, in Japanese Patent Application No. 2011-535423 with English translation.

Office Action issued Jan. 15, 2013 in Korean Patent Application No. 10-2012-7003457 (with English-language translation).

Office Action issued on Jul. 3, 2013 in the corresponding German Patent Application No. 11 2010 003 974.7 (with English Translation).

International Search Report Issued Nov. 16, 2010 in PCT/JP10/67552 Filed Oct. 6, 2010.

* cited by examiner

DOOR ENGAGEMENT DEVICE FOR ELEVATOR

TECHNICAL FIELD

The present invention relates to a door engagement device for an elevator, which brings car doors and landing doors of an elevator into engagement with each other.

BACKGROUND ART

An engagement-mechanism driving device for a conventional door engagement device for an elevator includes a vane driving link having a center-fold structure, which freely turnably connects an arm mounted turnably to a fixed portion of a door device main body and an arm extending from a driving cam mounted turnably onto the door engagement device mounted to a car door so as to drive a car-side engagement mechanism.

In the case of the engagement-mechanism driving device described above, when the door engagement device moves in a horizontal direction as viewed from the front of the door through a car-door opening/closing operation, a linear distance between a fixed shaft provided to the door device main body and a turning shaft of the driving cam included in the door engagement device changes. As a result, a center-fold portion of the vane driving link moves upward or downward.

By the above-mentioned movement, the arm extending from the driving cam turns about the turning shaft of the driving cam.

When the driving cam turns, an engagement vane provided to the car-side engagement mechanism moves to a door-closing side or a door-opening side by the driving cam to perform a gripping/releasing operation of a landing-side engagement mechanism (for example, see Patent Literature 1).

CITATION LIST

Patent Literature

Patent Literature 1: JP 2006-103882 A (Pages 3 to 7, FIG. 1)

SUMMARY OF INVENTION

Technical Problems

In the conventional door engagement device for the elevator, the vane driving link which connects the fixed portion of the door device main body and the driving cam of the engagement mechanism is required to drive the driving cam for operating the engagement vane of the engagement mechanism. Therefore, the above-mentioned door engagement device has the following problems.

A. A space in which the vane driving link moves is required inside the door device main body.

B. A length or shape of the vane driving link is required to be changed if a door width or a mounting height of the door engagement device differs.

C. The vane driving link is large. Therefore, mounting thereof requires efforts, and cost becomes high.

The present invention has been made to solve the problems described above, and has an object to provide a door engagement device for an elevator, for driving an engagement-mechanism driving device, with a reduced space at low cost.

Solution to Problems

According to the present invention, there is provided a door engagement device for an elevator, provided between a car door guided on a hanger rail of a door device main body to perform an opening/closing operation and a landing door for performing an opening/closing operation for a landing doorway, for opening/closing the landing door in association with the opening/closing operation of the car door, the door engagement device for an elevator including:

a car-side engagement mechanism for gripping a landing-side engagement mechanism provided to the landing door when the car door is opened/closed; and an engagement-mechanism driving device for driving the car-side engagement mechanism, in which the engagement-mechanism driving device includes:

a lever support shaft provided to the car door;

a lever main body provided turnably in a reciprocating manner between a start point and an end point about the lever support shaft;

turning guiding means for guiding turning of the lever main body turning about the lever support shaft; and biasing-force applying/changing means for applying a turning preventing force for preventing the turning of the lever main body and changing a direction of a biasing force to a direction of an anti-turning preventing force to the lever main body by action of the turning guiding means with movement of the car door.

Further, according to the present invention, there is provided a door engagement device for an elevator, provided between a car door guided on a hanger rail of a door device main body to perform an opening/closing operation and a landing door for performing an opening/closing operation for a landing doorway, for opening/closing the landing door in association with the opening/closing operation of the car door, the door engagement device for an elevator including:

an engagement vane for gripping a landing-side engagement mechanism provided to the landing door when the car door is opened/closed;

a cam support shaft provided to the car door;

a driving cam provided freely turnably in a reciprocating manner between a start point and an end point about the cam support shaft to actuate the engagement vane in association with turning;

a moving member provided to the driving cam;

a fixed cam fixed to the door device main body, including a cam groove for guiding the moving member; and biasing-force applying/changing means for applying a turning preventing force for preventing the turning of the driving cam and changing a direction of a biasing force to a direction of an anti-turning preventing force to the driving cam in middle of movement of the car door by the movement of the car door, in which the biasing-force applying/changing means is configured to:

apply, when the car door is opened, the turning preventing force to the driving cam having the moving member moved into the cam groove so as to apply a resistance force against door opening to the car door and apply the anti-turning preventing force to the driving cam to change a biasing direction of the driving cam as a result of turning of the driving cam about the cam support shaft with movement of the moving member along the cam groove of the fixed cam and movement of the cam support shaft; and apply, when the car door is closed, the turning preventing force to the driving cam to apply a resistance force against door closing to the car door just at time at which the moving member moves into the cam groove and apply the anti-turning preventing force to the driving cam to change the biasing direction of the driving cam as a result of turning of the driving cam about the cam support shaft with the movement of the moving member along the cam groove of the fixed cam and the movement of the cam support shaft.

Advantageous Effects of Invention

According to the door engagement device for an elevator of the present invention, the biasing-force applying/changing means is configured to: apply, when the car door is opened, the turning preventing force to the lever main body by the action of the turning guiding means so as to apply the resistance force against door opening to the car door and apply the anti-turning preventing force to the lever main body to change the direction of the biasing force to the lever main body in the middle of the door-opening operation of the car door; and apply, when the car door is closed, the turning preventing force to the lever main body to apply the resistance force against door closing to the car door in the initial state by the action of the turning guiding means and apply the anti-turning preventing force to the lever main body to change the direction of the biasing force to the lever main body in the middle of the door-closing operation of the car door. Therefore, for the car door, a function of exerting the resistance force against door opening when the door starts opening and exerting the resistance force against door closing immediately before the closure of the door can be realized by the existing engagement-mechanism driving device without increasing the number of components. As a result, manufacturing cost can also be prevented from being increased.

Further, according to the door engagement device for an elevator of the present invention, the biasing-force applying/changing means is configured to: apply, when the car door is opened, the turning preventing force to the driving cam having the moving member moved into the cam groove so as to apply the resistance force against door opening to the car door and apply the anti-turning preventing force to the driving cam to change the direction of the biasing force to the driving cam; and apply, when the car door is closed, the turning preventing force to the driving cam to apply the resistance force against door closing to the car door just at time at which the moving member moves into the cam groove and apply the anti-turning preventing force to the driving cam to change the direction of the biasing force to the driving cam. Therefore, for the car door, the function of exerting the resistance force against door opening when the door starts opening and exerting the resistance force against door closing immediately before the closure of the door can be realized by the existing engagement-mechanism driving device without increasing the number of components. As a result, the manufacturing cost can also be prevented from being increased.

Further, the lever main body and the lever support shaft are eliminated to further reduce the cost.

DESCRIPTION OF EMBODIMENTS

Figure 1:
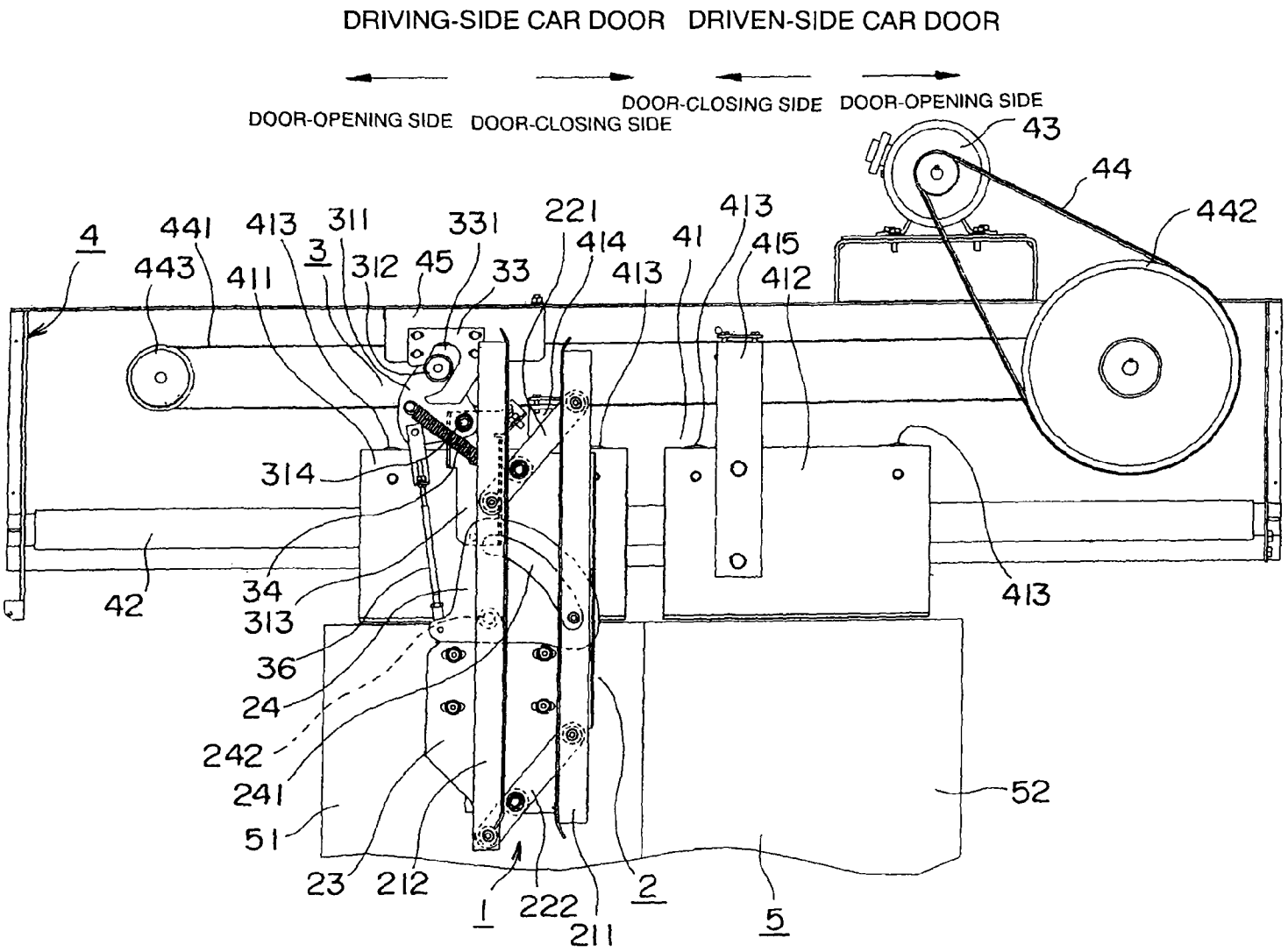
FIG. 1 is a front view of a door device for an elevator with double doors as viewed from a landing-door side.

Hereinbelow, embodiments of the present invention are described with reference to the drawings. In the drawings, the same or corresponding members and parts are represented by the same reference symbols in the description.

Embodiment 1

Figure 2:
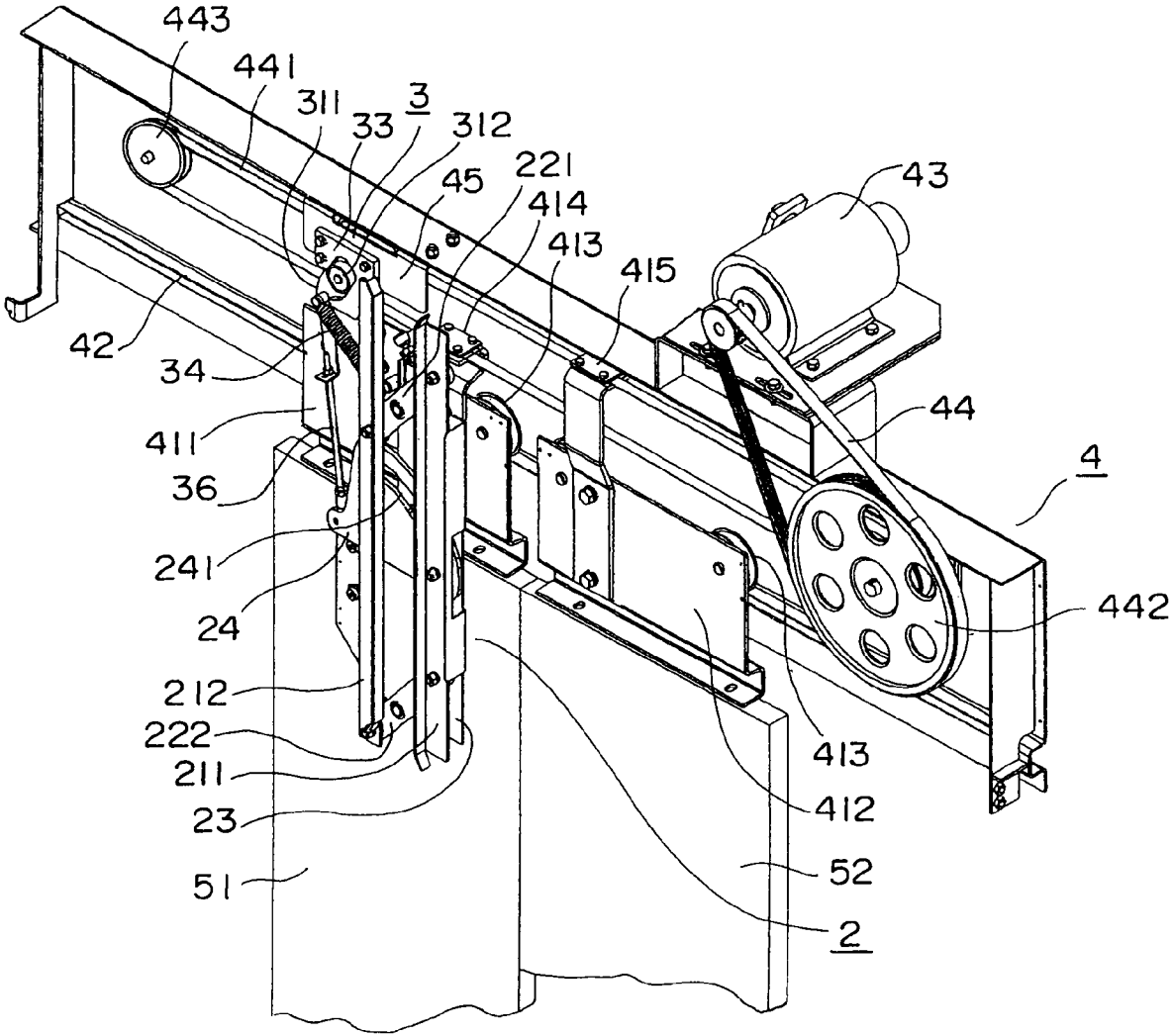
FIG. 2 is a perspective view illustrating the door device illustrated in FIG. 1.
Figure 3:
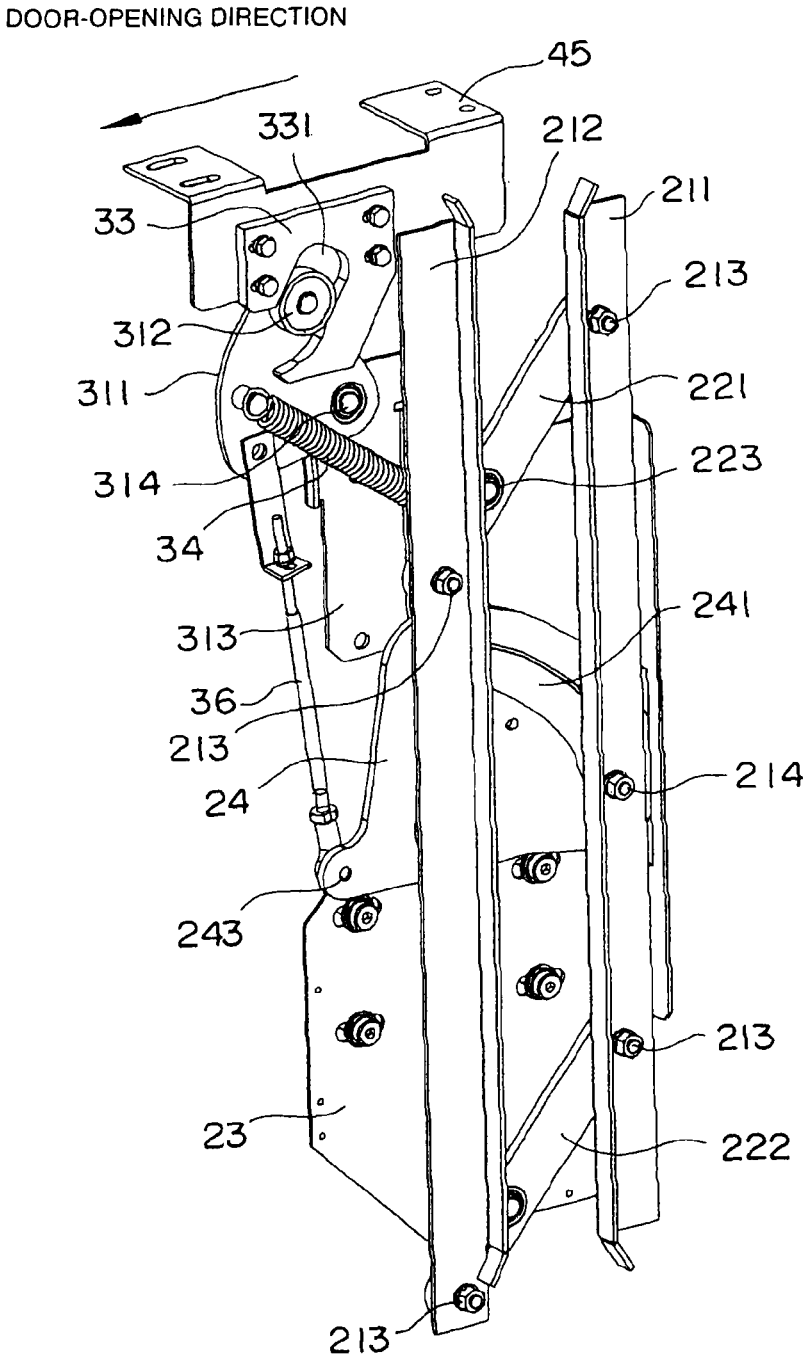
FIG. 3 is a perspective view illustrating a door engagement device of the door device illustrated in FIG. 1.
Figure 4:
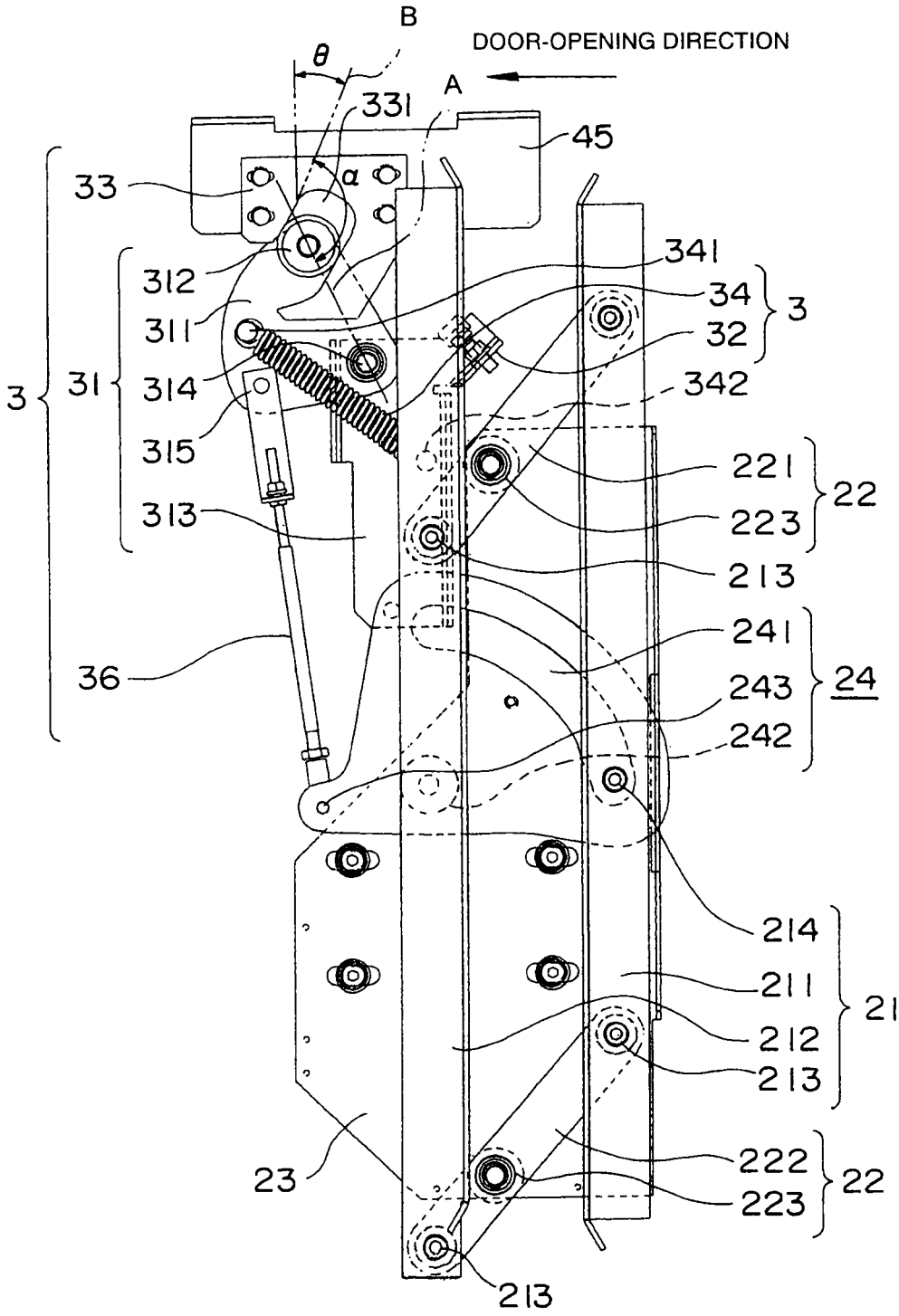
FIG. 4 is a front view illustrating one mode of use (initial state with doors open) of the door engagement device for the elevator, illustrated in FIG. 1.
Figure 5:
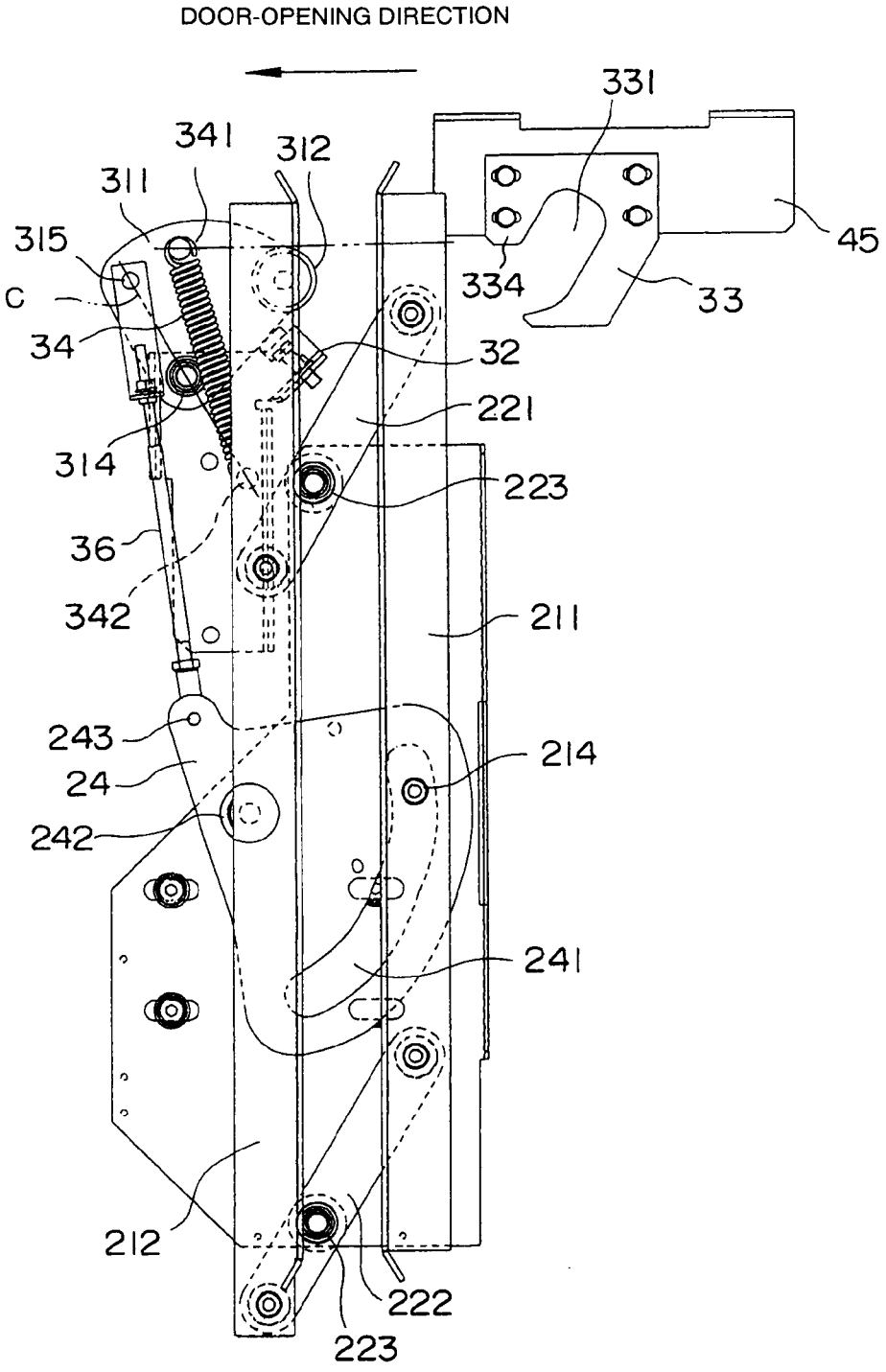
FIG. 5 is a front view illustrating another mode of use (vane-closed state) of the door engagement device 1 illustrated in FIG. 1.

FIG. 1 is a front view of a door device for an elevator with double doors as viewed from a landing-door side, FIG. 2 is a perspective view illustrating the door device illustrated in FIG. 1, FIG. 3 is a perspective view illustrating a door engagement device 1 of the door device illustrated in FIG. 1, FIG. 4 is a front view illustrating one mode of use (initial state with doors open) of the door engagement device for the elevator, illustrated in FIG. 1, and FIG. 5 is a front view illustrating another mode of use (vane-closed state) of the door engagement device 1 illustrated in FIG. 1.

The door device for the elevator includes a door device main body 4 for opening and closing car doors 5 and a door engagement device 1 provided between landing doors (not shown) for opening and closing a landing doorway and the car doors 5, for allowing the landing doors to perform an opening/closing operation in association with an opening/closing operation of the car doors 5.

The above-mentioned door device main body 4 includes a door driving motor 43, a driving pulley 442 provided on a driven-side car door 52 side of the car doors 5 including a driving-side car door 51 and the driven-side car door 52, a driving belt 44 provided between the driving pulley 442 and the door driving motor 43, for transferring a driving force of the door driving motor 43 to the driving pulley 442, an idler pulley 443 provided on the driving-side car door 51 side, and a belt 441 looped between the idler pulley 443 and the driving pulley 442.

The door device main body 4 also includes a hanger rail 42 extending below the belt 441 in parallel to the belt 441 and a door hanger 41 moving along the hanger rail 42.

The door hanger 41 includes a driving-side hanger plate 411 fixed onto an upper surface of the driving-side car door 51, a driven-side hanger plate 412 fixed onto an upper surface of the driven-side car door 52, hanger rollers 413 freely turnably provided to both upper corner portions of each of the driving-side hanger plate 411 and the driven-side hanger plate 412, for rolling on the hanger rail 42, a driving-side belt gripper 414 having a base end portion fixed to the driving-side hanger plate 411 and a distal end portion which grips a lower side of the endless belt 441, and a driven-side belt gripper 415 having a base end portion fixed to the driven-side hanger plate 412 and a distal end portion which grips an upper side of the endless belt 441.

The above-mentioned door-engagement device 1 includes a car-side engagement mechanism 2 provided on a base plate 23 fixed on a surface of the driving-side door 51 and an engagement-mechanism driving device 3 for driving the car-side engagement mechanism 2.

The car-side engagement mechanism 2 includes an engagement vane 21 including a first vane 211 and a second vane 212 opposed to the first vane 211 in parallel thereto, a vane link 22 including an upper vane link 221 and a lower vane link 222, which are connected to the first vane 211 and the second vane 212, and a driving cam 24 provided on the base plate 23, which has a cam groove 241 formed along an outer peripheral portion. The first vane 212 and the second vane 212 grip a landing-side engagement mechanism (not shown) provided to the landing door.

The above-mentioned engagement vane 21 includes vane support shafts 213 provided respectively to the first vane 211 and the second vane 212, for freely turnably supporting the upper vane link 211 and the lower vane link 222, respectively, and a cam follower 214 provided to the first vane 211 in a projecting manner, for moving along the cam groove 214 of the driving cam 24.

The first vane 211 and the second vane 212 constitute, together with the upper vane link 221 and the lower vane link 222 which are opposed to each other in parallel, a link mechanism in a parallelogram.

Link support shafts 223 freely turnable with respect to the base plate 23, are respectively provided to the upper vane link 221 and the lower vane link 222 at positions closer to the second vane 212 side.

The upper vane link 221 and the lower vane link 222 turn about the link support shafts 223. The first vane 211 and the second vane 212 move vertically as well as horizontally in association with the turning.

The above-mentioned driving cam 24 having a fan-like shape includes a cam support shaft 242 provided freely turnably with respect to the base plate 23 and a connection-bar mount shaft 243 provided to a base end portion on the side opposite to the side where the cam groove 241 is provided through the cam support shaft 242.

The cam groove 241 is formed so as to have a decreasing distance to the cam support shaft 242 in a counterclockwise direction and has an arc-like shape having the same radius from the middle.

The above-mentioned engagement-mechanism driving device 3 includes a fixed cam 33 fixed to a fixed portion 45 of the door device main body 4, a lever 31 provided to the driving-side hanger plate 411, a connection bar 36 to which the lever 31 and the connection-bar mount shaft 243 of the driving cam 24 are connected, a stopper 32 for stopping actuation of the lever 31, and a lever retention spring 34 for applying a resistance force against door opening (door-closing retention force) and a resistance force against door closing (door-opening retention force) for the car doors 5.

The above-mentioned lever 31 includes a mount plate 313 mounted to the driving-side hanger plate 411, a fan-like lever main body 311 provided turnable onto the mount plate 311 by a lever support shaft 314, a roller 312 corresponding to a moving member freely turnably provided to one corner portion of the lever main body 311, and a connection-bar mount shaft 315 provided to the other corner portion of the lever main body 311, to which a distal end portion of the connection bar 36 is connected.

The fixed cam 33 fixed to the door device main body 4, which has a cam groove 331, and the roller 312 corresponding to the moving member provided to the lever main body 311, which moves along the cam groove 331, constitute turning guiding means for guiding the turning of the lever main body 331.

The fixed cam 33 and the roller 312 are an example. Therefore, as the turning guiding means for guiding the turning of the lever main body, for example, a roller rolling on an end surface of a plate cam may be used.

One end portion of the above-mentioned lever retention spring 34 is connected to a lever spring-fixed point 341 provided to the lever main body 311, whereas the other end portion thereof is connected to a door spring-fixed point 342 provided to the mount plate 313.

The lever retention spring 34 applies a force for turning the lever main body 311 in a counterclockwise direction about the lever support shaft 314 when the lever main body 311 is in an initial position corresponding to a state in which the car doors 5 are closed. The force acts as a force for preventing the doors from opening, that is, the resistance force against door opening when the car doors 5 start opening and acts as a force for preventing the doors from being closed, that is, the resistance force against door closing from the middle of the door-opening operation of the car doors 5.

The lever spring-fixed point 341 provided to the lever main body 311, the door spring-fixed point 342 provided to the car doors 5, and the lever retention spring 34 which connects the lever spring-fixed point 341 and the door spring-fixed point 342 constitute biasing-force applying/changing means. The lever retention spring 34 is provided so that the lever spring-fixed point 341 is located on the opposite sides with respect to a straight line connecting the door spring-fixed point 342 and the lever support shaft 314 at a start point and an end point of movement of the lever main body 311.

The connection-bar mount shaft 243 of the driving cam 24 and the connection-bar mount shaft 315 of the lever 31 are connected to each other by the connection bar 36.

The cam groove 331 is formed on the above-mentioned fixed cam 33 at an angle $\theta$ ($\theta \geq 0°$) with respect to a vertical direction so that each of horizontal angles $\alpha$ of angles formed by crossing a guide line indicated by a two-dot chain line A connecting the center of the lever support shaft 314 and the center of the roller 312 and a guide line indicated by a two-dot chain line B extending along parallel guide surfaces of the cam groove 331, which are opposed to each other, becomes 90° or larger. The roller 312 provided to the lever main body 311 rolls along the cam groove 331.

Next, an operation of the door device for the elevator, which has the above-mentioned configuration, is described.

First, a door-opening operation of the car doors 5 is described.

By the driving of the door driving motor 43, the driving pulley 442 turns through an intermediation of the driving belt 44. With the turning of the driving pulley 442, the belt 441 moves.

With the movement of the belt 441, the driving-side hanger plate 411 and the driving-side car door 51, and the driven-side hanger plate 412 and the driven-side car door 52 start to move in a direction so as to be separated away from each other, specifically, each of the car doors 5 starts to move in a door-opening direction.

With the door opening of the car doors 5, a horizontal direction between the lever support shaft 314 of the lever 31 and the fixed cam 33 is reduced for the driving-side car door 51. Then, the roller 312 provided to the lever main body 311 moves up in the cam groove 331 so as to maintain a distance to the lever support shaft 314. With the upward movement, the lever main body 311 turns in a clockwise direction against an elastic force of the lever retention spring 34 about the lever support shaft 314.

By adjusting the inclination angle θ of the cam groove 331, the relation between a distance of movement of the driving-side hanger plate 411 and the angle of turning of the lever main body 311 is adjusted.

Specifically, when the inclination angle θ is increased in the clockwise direction, the angle of turning of the lever main body 311 becomes large with respect to the amount of movement of the driving-side hanger plate 411. When the angle θ is reduced, the angle of turning is reduced.

The resistance force against door opening also changes depending on the angle θ. When the angle θ is increased, the lever retention spring 34 is further extended to increase the resistance force against door opening. When the angle θ is reduced, the resistance force against door opening is reduced.

With the turning of the lever main body 311 in the clockwise direction, the connection-bar mount shaft 243 is pulled up through an intermediation of the connection bar 36 to turn the driving cam 24 about the cam support shaft 242 in the clockwise direction.

With the turning of the driving cam 24, the cam follower 214 mounted to the first vane 211 rolls along the wall surfaces of the cam grooves 241. As a result, the first vane 211 is forcibly moved in the door-opening direction.

With the driving of the first vane 211, the second vane 212 moves in the door-closing direction because the second vane 212 constitutes the parallel link mechanism together with the first vane 211, the upper vane link 221, and the lower vane link 222. As a result, a distance between the first vane 211 and the second vane 212 becomes smaller.

After the lever main body 311 turns to a predetermined position, the distance between the first vane 211 and the second vane 212 is constant in the further turning.

Specifically, after the driving-side hanger plate 411 moves by a preset distance, the first vane 211 is not further moved in the door-opening direction with the turning of the lever main body 311 because the cam groove 241 has the arc-like shape with the same radius with respect to the cam support shaft 242 from the middle thereof. Therefore, the first vane 211 and the second vane 212 are retained in a gripped state with the distance reduced by the set amount as compared with that in the initial state with the doors open.

The first vane 211 and the second vane 212 grip the landing-side engagement mechanism (not shown) provided to the landing door in the process of reduction of the distance. Thereafter, in association with the door opening of the car doors 5, the landing doors (not shown) are also opened.

By the rolling of the cam follower 214 provided to the first vane 211 along the cam groove 241, the first vane 211 moves in the door-opening direction. Therefore, a speed at which the first vane 211 and the second vane 212 come closer to each other, and the amount of movement of the driving-side hanger plate 411 until the first vane 211 and the second vane 212 are brought into the gripped state can be adjusted by the shape of the cam groove 241.

When the driving-side hanger plate 411 further moves in the door-opening direction, the lever main body 311 further turns in the clockwise direction against the elastic force of the lever retention spring 34. Moreover, the lever support shaft 314 moves in the door-opening direction. Therefore, the roller 312 is positioned on the vertical line of the lever support shaft 314 in the cam groove 331, specifically, the roller 312 reaches the highest point in the cam groove 331.

Thereafter, the roller 312 starts moving down in the cam groove 331 to roll to a notch portion 334 of the cam groove 331 to move out of the cam groove 331. Thereafter, simultaneously with the separation of the roller 312 from the cam groove 331, the lever main body 311 collides against the stopper 32 mounted to the mount plate 313 by the elastic force of the lever retention spring 34 so as to be stopped (see FIG. 5). The position is a turning end position of the lever main body 311.

The lever main body 311 and the driving cam 24 turn in association with the opening operation of the car doors 5 until the roller 312 separates away from the notch portion 334 of the cam groove 331.

Thereafter, the door engagement device 1 moves in the door-opening direction in the state illustrated in FIG. 5 until the amount of opening of the car doors 5 becomes equal to a predetermined amount of opening.

On the other hand, when the roller 312 moves out of the notch portion 334 of the cam groove 331, the lever spring-fixed point 341 of the lever retention spring 34 moves to the side opposite to that in the initial state with respect to a two-dot chain line C connecting the lever support shaft 314 and the door spring-fixed point 342 mounted to the mount plate 313.

Specifically, the turning direction of the lever main body 311 by the elastic force of the lever retention spring 34 changes from the counterclockwise direction to the clockwise direction to press the lever main body 311 against the stopper 32. As a result, the roller 312 moves out of the cam groove 331. At the same time, the lever main body 311 collides against the stopper 32 mounted to the mount plate 313 by the elastic force of the lever retention spring 34 so as to be stopped.

When the car doors 5 start opening, the lever retention spring 34 applies the force in a direction of turning the lever main body 311 in the counterclockwise direction so that the force acts as the force for preventing the turning of the lever main body 311, that is, the resistance force against door opening. After the roller 312 moves out of the cam groove 331, the force of the lever retention spring 34 acts as the force for retaining the lever main body 311 in the turning end position.

Next, a door-closing operation of the car doors 5 is described.

The operation of the door engagement device 1 during the door-closing operation of the car doors 5 is reverse to that during the above-mentioned door-opening operation of the car doors 5.

In the door-closing operation, when the car doors 5 are closed, specifically, by the driving of the door driving motor 43, the belt 411 moves in the direction opposite to the door-opening direction so that the driving-side hanger plate 411 and the driven-side hanger plate 412 move closer to each other. When the driving-side hanger plate 411 reaches a predetermined position, the roller 312 moves into the cam groove 331 of the fixed cam 33 through the notch portion 334.

Thereafter, as the car doors 5 are closed, the roller 312 rolls upward along the cam groove 331 so as to maintain the distance to the lever support shaft 314 of the lever retention spring 34. Moreover, the lever support shaft 314 moves in the door-closing direction. Therefore, the roller 312 moves down again after reaching the highest point at which the roller 312 has a vertical relation with the lever support shaft 314.

By the movement of the roller 312, the lever main body 311 turns in the direction opposite to that during the door-opening operation, that is, in the counterclockwise direction to turn the driving cam 24 about the cam support shaft 242 in the counterclockwise direction through an intermediation of the connection bar 36.

The force of the lever retention spring 34 is applied in the direction in which the lever main body 311 is turned in the clockwise direction just at the time at which the roller 312 moves into the cam groove 331 and acts as a force for preventing the turning of the lever main body 311, that is, the resistance force against door closing.

After the roller 312 moves into the cam groove 331 of the fixed cam 33, the driving-side hanger plate 411 is closed to a predetermined position. Then, by the movement of the driving cam 24 guided by the cam groove 241 which moves in association with the movement of the roller 312, the first vane 211 moves to the door-closing side through an intermediation of the cam follower 214. Then, the first vane 211 and the second vane 212 start opening in a direction of moving away from each other. Thereafter, when the car doors 5 are fully closed, the door engagement device 1 returns to the initial state.

The movement of the first vane 211 and the second vane 212 away from each other releases the gripped state by the landing-side engagement mechanism.

According to the door engagement device 1 for the elevator according to this embodiment, when the car doors 5 are opened, the biasing-force applying/changing means applies the turning preventing force to the lever main body 311 having the roller 312 corresponding to the moving member moved into the cam groove 331 so as to apply the resistance force against door opening to the car doors 5 and applies an anti-turning preventing force to the lever main body 311 to change a direction of a biasing force to the lever main body 311. Further, when the car doors 5 are closed, the biasing-force applying/changing means applies the turning preventing force to the lever main body 311 to apply the resistance force against door closing to the car doors 5 just at the time at which the roller 312 moves into the cam groove 331 and applies the anti-turning preventing force to the lever main body 311 to change the direction of the biasing force to the lever main body 311. Therefore, the resistance force against door opening (door-closing retention force) acts on the car doors 5 when the doors start opening. Therefore, even if electric power to the door driving motor 43 is interrupted for some reason, the car doors 5 can be prevented from being opened. Moreover, the resistance force against door closing acts immediately before the doors are closed. In this manner, an impact noise between the driving-side car door 51 and the driven-side car door 52, which is generated when the doors are closed, can be alleviated.

The biasing-force applying/changing means includes the lever spring-fixed point 341 provided to the lever main body 311, the door spring-fixed point 342 provided to the car doors 5, and the lever retention spring 34 connecting the lever spring-fixed point 341 and the door spring-fixed point 342. The lever retention spring 34 is provided so that the lever spring-fixed point 341 is located on the opposite sides with respect to the straight line connecting the door-spring fixed point 342 and the lever support shaft 314 at the start point and the end point of movement of the lever main body 311. Therefore, a function of exerting the resistance force against door opening when the doors start opening and exerting the resistance force against door closing immediately before the closure of the doors can be realized by the existing engagement-mechanism driving device without increasing the number of components. As a result, manufacturing cost can be prevented from being increased.

Further, according to the door engagement device 1 for the elevator according to this embodiment, the driving cam 24 is turned through an intermediation of the connection bar 36 with the turning of the lever main body 311. With the turning, the cam follower 214 rolls inside the cam groove 241 to move the first vane 211 and the second vane 212 closer to each other or away from each other. Therefore, even if the vane driving link which connects the fixed portion 45 of the door device main body 4 and the driving cam 24 is eliminated, the first vane 211 and the second vane 212 can be driven to be opened/closed.

Further, even if the position at which the door engagement device 1 is mounted changes vertically, the change can be covered by changing a length of the connection bar 36. In addition, even if the width of the car doors 5 changes, the first vane 211 and the second vane 212 can be driven with the same components. Therefore, the components other than the connection bar 36 can be commonly used.

Further, the roller 312 separates away from the cam groove 331 of the fixed cam 33 before the car doors 5 are fully opened. Thus, it is not necessary to form the fixed cam 33 over the entire range of movement of the driving-side car door 51. As a result, the engagement-mechanism driving device 3 can be configured with a saved space.

Embodiment 2

Figure 6:
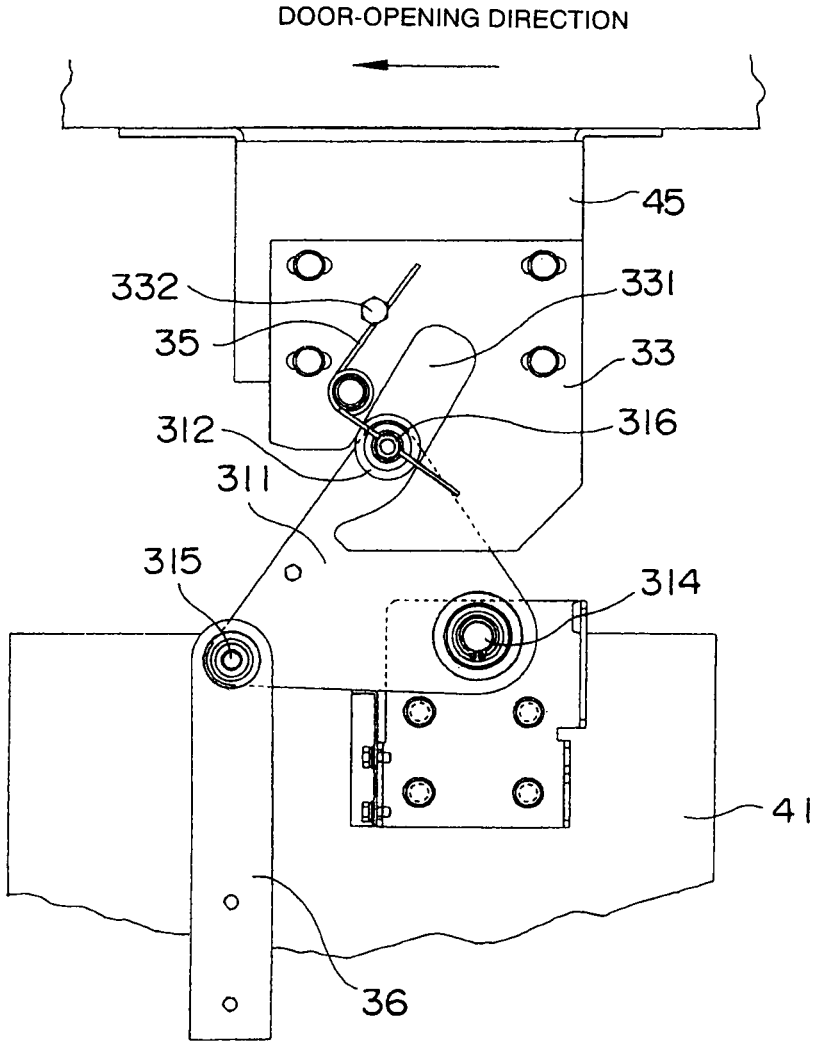
FIG. 6 is a front view illustrating the principal part of the door engagement device according to Embodiment 2 of the present invention.

FIG. 6 is a front view illustrating the door engagement device 1 according to Embodiment 2 of the present invention.

In the engagement-mechanism driving device 3 according to Embodiment 2, the lever 31 mounted to the door hanger 41 includes the mount plate 313, the lever support shaft 314 provided to the mount plate 313, the lever main body 311 having a triangular shape, mounted turnably to the lever support shaft 314, and the roller 312 corresponding to the moving member mounted onto the lever main body 311.

A resistance spring 35 corresponding to resistance force applying means including a torsion spring, for applying a force for preventing the turning when the lever main body 311 turns, is mounted to the fixed cam 33.

The resistance spring 35 is provided in the vicinity of the cam groove 331 of the fixed cam 33. One end portion of the resistance spring 35 is fixed onto the fixed cam 33 by a resistance spring fixing portion 332, whereas the other end thereof is a free end portion which projects across the cam groove 331. A portion to which the roller 312 is mounted is a contact portion 316 against which the free end portion of the resistance spring 35 abuts.

The contact portion 316 is located on the opposite sides with respect to a vertical line passing through the lever support shaft 314 at a start point and an end point of the turning of the lever main body 311 which turns about the lever support shaft 314.

The remaining configuration is the same as that of Embodiment 1.

Next, an operation of the door engagement device 1 for the elevator according to Embodiment 2, which has the above-mentioned configuration, is described.

When the door hanger 41 moves in the door-opening direction to reduce a horizontal distance between the fixed cam 33 and the lever support shaft 314, the roller 312 is guided by the cam groove 331 to be going to move upward so as to maintain a distance between the lever support shaft 314 and the roller 312.

Then, the contact portion 316 of the roller 312 comes into contact with the free end portion of the resistance spring 35 to lift up the free end portion so that a force for returning back the roller 312 downward is exerted by the resistance spring 35. The force acts as the resistance force against door opening.

In the case where the car doors 5 are closed, when the roller 312 moves into the cam groove 331 of the fixed cam 33 in the middle of the door-closing operation, the roller 312 is going to move upward along the cam groove 331. At this time, the lever main body 311 is subjected to a force for pushing back the lever main body 311 downward by the resistance spring 35. The force for pushing back downward acts as the resistance force against door closing.

According to the door engagement device 1 for the elevator according to this embodiment, the biasing-force applying/changing means includes the resistance spring 35 corresponding to the resistance force applying means provided to the fixed cam 33, which applies the resistance force in a direction for preventing the movement of the roller 312 moving along the cam groove 331 of the fixed cam 33 when the car doors 5 are opened/closed. The contact portion 316 at which the resistance spring 35 abuts against the roller 312 is located on the opposite sides with respect to the vertical line passing through the lever support shaft 314 at the start point and the end point of the turning of the lever main body 311. Therefore, the resistance force against door opening can be exerted on the car doors 5 when the doors start opening, whereas the resistance force against door closing can be exerted on the car doors 5 immediately before the doors are closed. Thus, the same effects as those of Embodiment 1 can be obtained.

Moreover, by adjusting the elastic force of the resistance spring 35, the door-closing retention force and the resistance force against door closing can be easily adjusted.

Although the torsion spring is used as the resistance spring 35, a compression spring or a leaf spring may be used instead.

Embodiment 3

Figure 7:
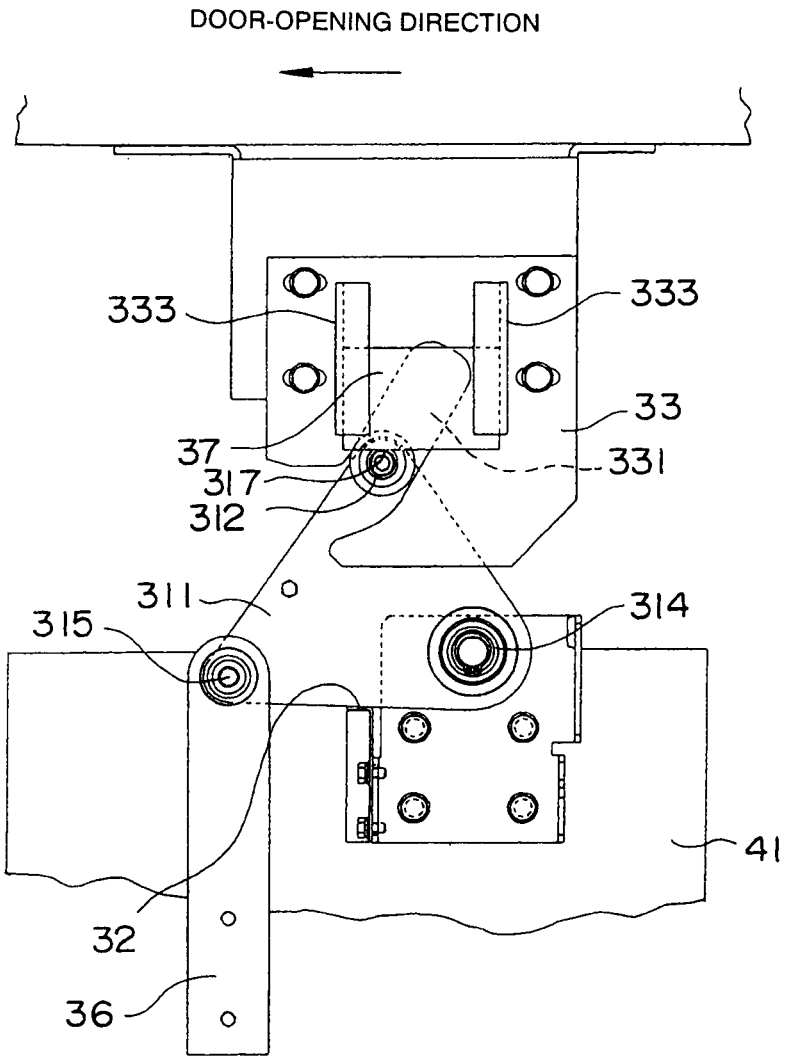
FIG. 7 is a front view illustrating the principal part of the door engagement device according to Embodiment 3 of the present invention.

FIG. 7 is a front view illustrating the door engagement device 1 according to Embodiment 3 of the present invention.

In this embodiment, a resistance weight 37 is used as the resistance force applying means in place of the resistance spring 35.

In the case of the door engagement device described above, the resistance weight 37 is provided so as to be vertically movable along resistance weight guides 333 fixed to the fixed cam 33 to close a passage of the cam groove 331. The resistance weight 37 applies a downward force to a contact portion 317, which acts as a force for bringing back the upward movement of the roller 312 downward.

According to the door engagement device 1 of this embodiment, the biasing-force applying/changing means includes the resistance weight 37 corresponding to the resistance force applying means provided to the fixed cam 33, which applies the resistance force in a direction for preventing the movement of the moving member 312 moving along the cam groove 331 of the fixed cam 33 when the car doors 5 are opened/closed. The contact portion 317 at which the resistance weight 37 abuts against the roller 312 is located on the opposite sides with respect to the vertical line passing through the lever support shaft 314 at the start point and the end point of the turning of the lever main body 311. Therefore, the resistance force against door opening can be exerted on the car doors 5 when the doors start opening, whereas the resistance force against door closing can be exerted on the car doors 5 immediately before the doors are closed. Thus, the same effects as those of Embodiment 1 can be obtained.

Moreover, by adjusting the weight of the resistance weight 37, the door-closing retention force and the resistance force against door closing can be easily adjusted.

Embodiment 4

Figure 8:
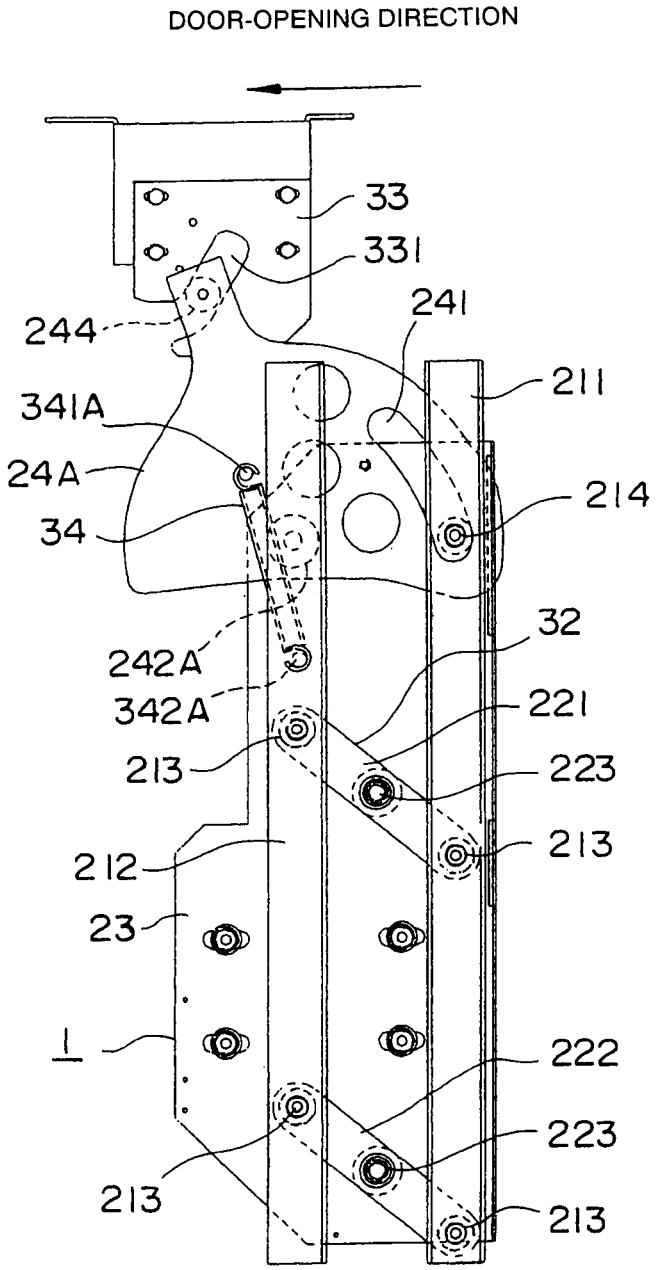
FIG. 8 is a front view illustrating the door engagement device for the elevator according to Embodiment 4 in an initial state when the doors are opened.
Figure 9:
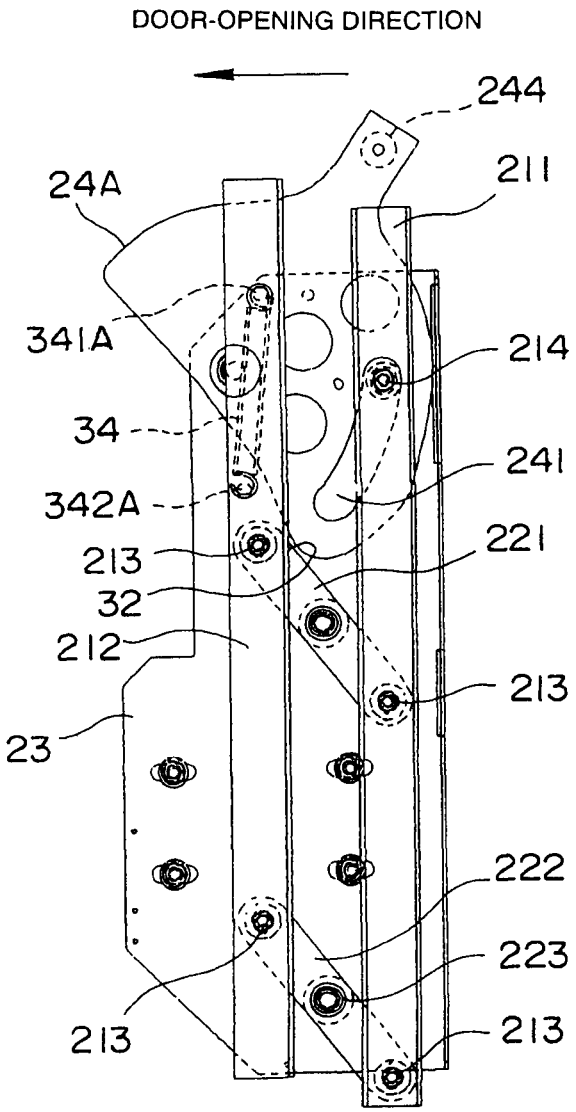
FIG. 9 is a front view illustrating a vane-closed state of the door engagement device for the elevator, which is illustrated in FIG. 8.

FIG. 8 is a front view illustrating the door engagement device 1 for the elevator according to Embodiment 4 in an initial state when the doors are opened, and FIG. 9 is a front view illustrating a vane-closed state of the door engagement device for the elevator, which is illustrated in FIG. 8.

In this embodiment, a driving cam 24A also serves as the lever main body 311, and therefore the connection bar 36 is not provided.

A roller 244 corresponding to a moving member is mounted to the driving cam 24A so that the roller 244 rolls inside the cam groove 331 of the fixed cam 33.

The remaining configuration is the same as that of Embodiment 1.

In this embodiment, when the car doors 5 move, the driving cam 24 is turned about a cam support shaft 242A to drive the car-side engagement mechanism 2.

Specifically, in Embodiment 1, the movement of the lever main body 311 is transferred to the driving cam 24 by the connection bar 36 to turn the driving cam 24. However, the roller 244 is mounted to the driving cam 24A to directly turn the driving cam 24A.

The lever retention spring 34 is mounted so as to retain the driving cam 24A instead of retaining the start point and the end point of the turning of the lever main body 311, which is described in Embodiment 1. As a result, the elastic force of the lever retention spring 34 acts so that the driving cam 24A is retained in the closed state of the engagement vane 21 or the open state of the engagement vane 21 and acts as the resistance force against door opening when the doors start opening and as the resistance force against door closing immediately before the doors are closed.

Next, an operation of the above-mentioned door engagement device 1 for the elevator according to Embodiment 4 is described.

When the car doors 5 start moving in the door-opening direction, a horizontal distance between the cam support shaft 242A of the driving cam 24A and the fixed cam 33 is reduced as in Embodiment 1. For maintaining the distance between the roller 244 and the cam support shaft 242A, the roller 244 rolls upward inside the cam groove 331.

When the car doors 5 are further opened, the roller 244 reaches the highest point inside the cam groove 331 and then starts moving downward. When the car doors 5 are opened to a predetermined position, the roller 244 moves out of the cam groove 331. When the roller 244 moves out of the cam groove 331, the driving cam 24A abuts against the stopper 32 corresponding to the end surface of the upper vane link 221 to stop moving (see FIG. 9).

Thereafter, the door engagement device 1 moves in the above-mentioned state until the door opening is completed.

By the movement of the roller 244 as described above, the driving cam 24A turns in the clockwise direction about the cam support shaft 242A. Then, the cam groove 241 formed on the driving cam 24A also turns, and the cam follower 214 provided to the first vane 211 is guided by the cam groove 241 to drive the first vane 211 to the door-opening side.

The first vane 211 and the second vane 212 constitute the parallel link with the upper vane link 221 and the lower vane link 222. Therefore, when the first vane 211 moves to the door-opening side, the second vane 212 moves to the door-closing side. As a result, the engagement vane 21 of the car-side engagement mechanism 2 is closed.

As in Embodiment 1, the movement performed when the car doors 5 are closed is reverse to that performed when the doors are opened.

Specifically, when the car doors 5 are closed to a predetermined position, the roller 244 provided to the driving cam 24A moves into the cam groove 331 of the fixed cam 33 and moves upward inside the cam groove 331. Thereafter, the roller 244 reaches the highest point to move downward and returns to the initial position in the door-closed state.

By the above-mentioned operation, the driving cam 24A turns in the counterclockwise direction to open the engagement vane 21 of the car-side engagement mechanism 2 with the operation reverse to that performed when the doors are opened.

According to the door engagement device 1 for the elevator according to this embodiment, when the car doors 5 are opened, the biasing-force applying/changing means applies the turning preventing force to the driving cam 24A having the roller 244 corresponding to the moving member moved into the cam groove 331 so as to apply the resistance force against door opening to the car doors 5. With the movement of the roller 244 along the cam groove 331 of the fixed cam 33 and the movement of the cam support shaft 242A, the driving cam 24A turns about the cam support shaft 242A to apply the anti-turning preventing force to the driving cam 24A so as to change the biasing direction of the driving cam 24A. When the car doors 5 are closed, the biasing-force applying/changing means applies the turning preventing force to the driving cam 24A to apply the resistance force against door closing to the car doors 5 just at the time at which the roller 244 moves into the cam groove 331. With the movement of the roller 244 along the cam groove 331 of the fixed cam 33 and the movement of the cam support shaft 242A, the driving cam 24A turns about the cam support shaft 242A to apply the anti-turning preventing force to the driving cam 24A so as to change the biasing direction of the driving cam 24A. Therefore, the same effects as those of the door engagement device 1 for the elevator according to Embodiment 1 can be obtained. In addition, in comparison with the door engagement devices according to Embodiments 1 to 3, the lever main body 311 and the lever support shaft 314 are eliminated to simplify the configuration of the lever 31. Thus, the door engagement device 1 can be provided at further lower cost.

Embodiment 5

Figure 10:
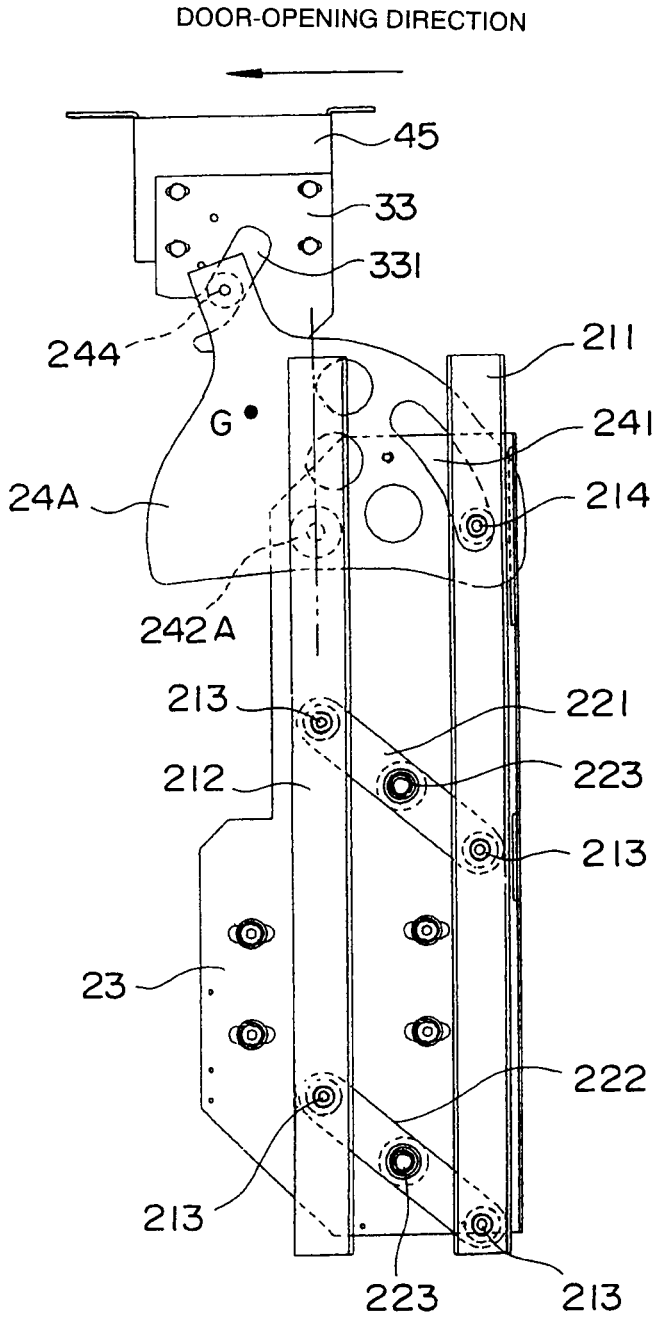
FIG. 10 is a front view of the door engagement device for the elevator according to Embodiment 5 in an initial state when the doors are opened.
Figure 11:
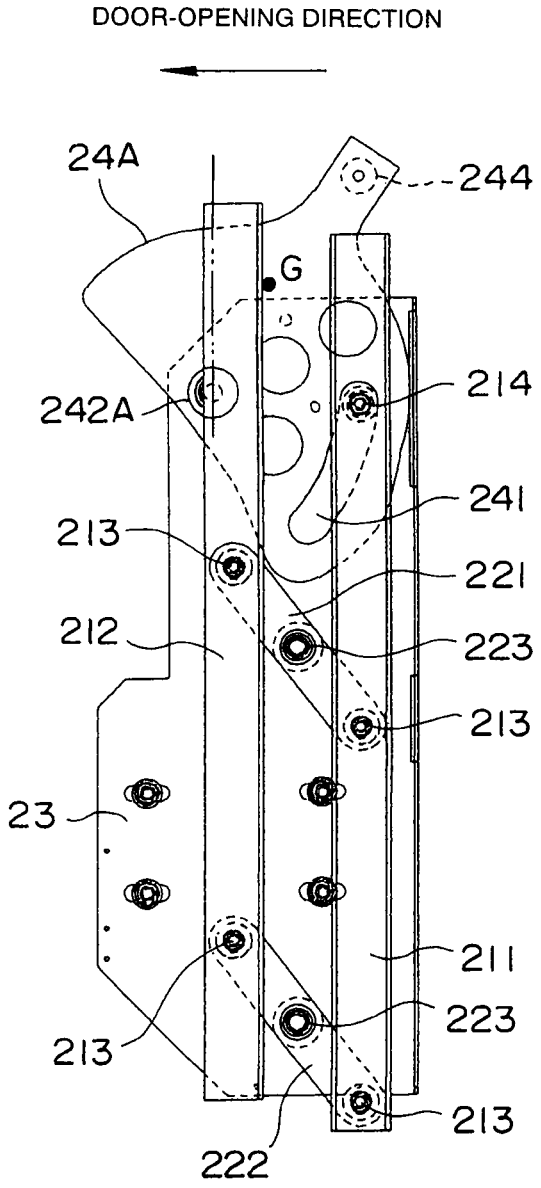
FIG. 11 is a front view illustrating another mode of use (vane-closed state) of the door engagement device for the elevator, which is illustrated in FIG. 10.

FIG. 10 is a front view of the door engagement device 1 for the elevator according to Embodiment 5 in an initial state when the doors are opened, and FIG. 11 is a front view illustrating another mode of use (vane-closed state) of the door engagement device for the elevator, which is illustrated in FIG. 10.

In this embodiment, instead of providing the lever retention spring 34, a thickness of the driving cam 24A on the door-opening direction side is increased so that a position G of center of gravity of the driving cam 24A is located on the left with respect to a vertical line passing through the cam support shaft 242A when the car-side engagement mechanism 2 is in an open state and located on the right when the car-side engagement mechanism 2 is in a closed state.

As described above, in this embodiment, the biasing-force applying/changing means is the driving cam 24A having the position of center of gravity which is located on the opposite sides with respect to the vertical line passing through the cam support shaft 242A at the start point and the end point of the turning of the driving cam 24A. Therefore, in comparison with Embodiment 4, the lever retention spring 34 is not required. Accordingly, the door engagement device 1 can be provided at further lower cost.

The position G of center of gravity of the driving cam 24A may be decentered so that the position G of center of gravity of the driving cam 24A is located on the left with respect to the vertical line passing through the cam support shaft 242A when the car-side engagement mechanism 2 is in the open state and located on the right when the car-side engagement mechanism 2 is in the closed state.

In each of the embodiments described above, the roller 312 or 244 is used as the moving member guided by the fixed cam 33. However, it is apparent that the moving member is not limited to the roller 312 or 244 and may be a slide shoe member or the like.

Moreover, although the lever support shaft 314 is fixed to the driving-side car door 51 through an intermediation of the mount plate 313 in Embodiments 1 to 3, the lever support shaft 314 may be directly fixed to the driving-side car door 51.

Further, by using the resistance spring 35 of Embodiment 2 or the resistance weight 37 of Embodiment 3 together with the lever retention spring 34 according to Embodiments 1 and 4, the resistance spring 35 or the resistance weight 37 can be reduced in size. As a result, the lever main body 311 and the driving cam 24A can be reduced in size.

Further, the configuration for applying the turning force of the driving cam 24A by adjusting the position of center of gravity of the driving cam 24A, which is described in Embodiment 5, can be used in place of the lever retention spring 34, the resistance spring 35, or the resistance weight 37 so as to be applied to the lever main body 311 of Embodiments 1 to 3 and the driving cam 24A of Embodiment 4. Moreover, by using the configuration together with the lever retention spring 34, the resistance spring 35, or the resistance weight 37, the lever main body 311 and the driving cam 24A can be reduced in size.

Further, in each of the embodiments described above, the guide surfaces of the cam groove 331 have a linear shape. However, by providing a curve shape, the lever main body 311 or the driving cam 24A turns more smoothly to smooth the actuation of the first vane 211 and the second vane 212.

REFERENCE SIGNS LIST

1 door engagement device, 2 car-side engagement mechanism, 21 engagement vane, 211 first vane, 212 second vane, 213 vane support shaft, 214 cam follower, 22 vane link, 221 upper vane link, 222 lower vane link, 223 link support shaft, 23 base plate, 24, 24A driving cam, 241 cam groove, 242, 242A cam support shaft, 243 connection-bar mount shaft, 244 roller (moving member), 3 engagement-mechanism driving device, 31 lever, 311 lever main body, 312 roller (moving member), 313 mount plate, 314 lever support shaft, 315 connection-bar mount shaft, 316, 317 contact portion, 32 stopper, 33 fixed cam, 331 cam groove, 332 resistance spring fixing portion, 333 resistance weight guide, 334 notch portion, 34 lever retention spring, 341 lever spring-fixed point, 341A cam spring-fixed point, 342, 342A door spring-fixed point, 35 resistance spring, 36 connection bar, 37 resistance weight, 4 door device main body, 41 door hanger, 411 driving-side hanger plate, 412 driven-side hanger plate, 413 hanger roller, 414 driving-side belt gripper, 415 driven-side belt gripper, 42 hanger rail, door driving motor, 44 driving belt, 45 fixed portion, 441 belt, 442 driving pulley, 443 idler pulley, 5 car door, 51 driving-side car door, driven-side car door

The invention claimed is:

1. A door engagement device for an elevator, provided between a car door guided on a hanger rail of a door device main body to perform an opening/closing operation and a landing door for performing an opening/closing operation for a landing doorway, for opening/closing the landing door in association with the opening/closing operation of the car door, the door engagement device comprising:

a car-side engagement mechanism for gripping a landing-side engagement mechanism provided to the landing door when the car door is opened/closed; and an engagement-mechanism driving device for driving the car-side engagement mechanism, wherein the engagement-mechanism driving device comprises:

a lever support shaft provided to the car door;

a lever main body provided turnably in a reciprocating manner between a start point and an end point about the lever support shaft;

turning guiding means for guiding turning of the lever main body in a rotational direction about the lever support shaft; and biasing-force applying/changing means provided to the car door for applying a rotational biasing force to the lever main body, the biasing force comprising a turning preventing force for preventing the turning of the lever main body in the rotational direction, and for changing a direction of the biasing force with movement of the car door such that the biasing force comprises an anti-turning preventing force for assisting the turning of the lever main body in the rotational direction when a force direction of the biasing-force applying/changing means crosses the lever support shaft.

2. A door engagement device for an elevator according to claim 1, wherein the biasing-force applying/changing means comprises:

a lever spring-fixed point provided to the lever main body;

a door spring-fixed point provided to the car door; and a lever retention spring connecting the lever spring-fixed point and the door spring-fixed point; and wherein the lever retention spring is provided so that the lever spring-fixed point is located on opposite sides with respect to a straight line connecting the door spring-fixed point and the lever support shaft at the start point and the end point of the movement of the lever main body.

3. A door engagement device for an elevator according to claim 1, wherein the car-side engagement mechanism comprises:

an engagement vane for gripping the landing-side engagement mechanism;

a cam support shaft provided to the car door;

a driving cam including a cam groove, provided freely turnably to the cam support shaft;

a cam follower provided to the engagement vane, for rolling inside the cam groove; and a connection bar for connecting the driving cam and the lever main body; and wherein the driving cam is turned through an intermediation of the connection bar with turning of the lever main body, and the cam follower rolls inside the cam groove with the turning to actuate the engagement vane.

4. A door engagement device for an elevator, provided between a car door guided on a hanger rail of a door device main body to perform an opening/closing operation and a landing door for performing an opening/closing operation for a landing doorway, for opening/closing the landing door in association with the opening/closing operation of the car door, the door engagement device comprising:

a car-side engagement mechanism for gripping a landing-side engagement mechanism provided to the landing door when the car door is opened/closed; and an engagement-mechanism driving device for driving the car-side engagement mechanism, wherein the engagement-mechanism driving device comprises:

a lever support shaft provided to the car door;

a lever main body provided turnably in a reciprocating manner between a start point and an end point about the lever support shaft;

turning guiding means for guiding turning of the lever main body in a rotational direction about the lever support shaft; and biasing-force applying/changing means for applying a rotational biasing force to the lever main body, the biasing force comprising a turning preventing force for preventing the turning of the lever main body in the rotational direction, and for changing a direction of the biasing force with movement of the car door such that the biasing force comprises an anti-turning preventing force for assisting the turning of the lever main body in the rotational direction when a force direction of the biasing-force applying/changing means crosses the lever support shaft;

wherein the turning guiding means comprises:

a fixed cam fixed to the door device main body, including a cam groove; and a moving member provided to the lever main body, for moving along the earn groove; and wherein the biasing-force applying/changing means is configured to:

apply, when the car door is opened, the turning preventing force to the lever main body having the moving member moved into the cam groove so as to apply a resistance force against door opening to the car door and apply the anti-turning preventing force to the lever main body to change the direction of the biasing force to the lever main body as a result of turning of the lever main body about the lever support shaft with movement of the moving member along the cam groove of the fixed cam and movement of the lever support shaft; and apply, when the car door is closed, the turning preventing force to the lever main body to apply a resistance force against door closing to the car door just at time at which the moving member moves into the cam groove and apply the anti-turning preventing force to the lever main body to change the direction of the biasing force to the lever main body as a result of turning of the lever main body about the lever support shaft with the movement of the moving member along the cam groove of the fixed cam and the movement of the lever support shaft.

5. A door engagement device for an elevator according to claim 4, wherein the biasing-force applying/changing means comprises resistance force applying means provided to the fixed cam, for applying a resistance force in a direction for preventing movement of the moving member moving along the cam groove of the fixed cam when the car door is opened/closed, and wherein a contact portion at which the resistance force applying means abuts against the moving member when the force direction crosses the lever support shaft.

6. A door engagement device for an elevator according to claim 5, wherein the resistance force applying means comprises a resistance spring having one end portion abutting against the contact portion.

7. A door engagement device for an elevator according to claim 5, wherein the resistance force applying means comprises:

a resistance weight having a lower surface abutting against the contact portion; and resistance weight guides provided so as to be opposed to each other, for guiding the resistance weight to move vertically.

8. A door engagement device for an elevator, provided between a car door guided on a hanger rail of a door device main body to perform an opening/closing operation and a landing door for performing an opening/closing operation for a landing doorway, for opening/closing the landing door in association with the opening/closing operation of the car door, the door engagement device for an elevator comprising:

an engagement vane for gripping a landing-side engagement mechanism provided to the landing door when the car door is opened/closed;

a cam support shaft provided to the car door;

a driving cam provided freely turnably in a reciprocating manner between a start point and an end point about the cam support shaft to actuate the engagement vane in association with turning;

a moving member provided to the driving cam;

a fixed cam fixed to the door device main body, including a cam groove for guiding the moving member provided to the driving cam when turning the driving cam in a rotational direction; and biasing-force applying/changing means for applying a rotational biasing force to the driving cam, the biasing force comprising a turning preventing force for preventing the turning of the driving cam in the rotational direction, and for changing a direction of the biasing force such that the biasing force comprises an anti-turning preventing force for assisting the turning of the driving cam in the rotational direction when a force direction of the biasing-force applying/changing means crosses the cam support shaft, wherein the biasing-force applying/changing means is configured to:

apply, when the car door is opened, the turning preventing force to the driving cam having the moving member moved into the cam groove so as to apply a resistance force against door opening to the car door and apply the anti-turning preventing force to the driving cam to change a biasing direction of the driving cam as a result of turning of the driving cam about the cam support shaft with movement of the moving member along the cam groove of the fixed cam and movement of the cam support shaft; and apply, when the car door is closed, the turning preventing force to the driving cam to apply a resistance force against door closing to the car door just at time at which the moving member moves into the cam groove and apply the anti-turning preventing force to the driving cam to change the biasing direction of the driving cam as a result of turning of the driving cam about the cam support shaft with the movement of the moving member along the cam groove of the fixed cam and the movement of the cam support shaft.

9. A door engagement device for an elevator according to claim 8, wherein the biasing-force applying/changing means comprises:

a cam spring-fixed point provided to the driving cam;

a door spring-fixed point provided to the car door; and a lever retention spring connecting the cam spring-fixed point and the door spring-fixed point; and wherein the lever retention spring is provided so that the cam spring-fixed point is located on opposite sides with respect to a straight line connecting the door spring-fixed point and the cam support shaft at the start point and the end point of the movement of the driving cam.

* * * * *